United States Patent [19]

Saito et al.

[11] 4,248,906

[45] Feb. 3, 1981

[54] PROCESS FOR PREPARING INSOLUBLE ELECTRODE

[75] Inventors: Shunjiro Saito; Saburo Ishibashi; Nobuei Shimojo, all of Tokyo, Japan

[73] Assignee: TDK Electronics Company, Limited, Tokyo, Japan

[21] Appl. No.: 79,938

[22] Filed: Sep. 28, 1979

Related U.S. Application Data

[63] Continuation of Ser. No. 896,385, Apr. 14, 1979, abandoned.

[30] Foreign Application Priority Data

Jul. 19, 1977 [JP] Japan ..... 52-86193

[51] Int. Cl.[3] ..... B05D 5/12

[52] U.S. Cl. ..... 427/125; 204/290 R; 204/290 F; 427/126.5; 427/229; 427/376.3; 427/383.7

[58] Field of Search ..... 204/290 F, 290 R; 427/126, 229, 376 B, 383 C, 126.5, 125

[56] References Cited

U.S. PATENT DOCUMENTS

| | | | |
|---|---|---|---|
| 3,632,498 | 1/1972 | Beer | 204/290 F |
| 3,773,555 | 11/1973 | Coltan et al. | 204/290 F |
| 3,864,163 | 2/1975 | Beer | 204/290 F |

FOREIGN PATENT DOCUMENTS

| | | | |
|---|---|---|---|
| 1147442 | 4/1969 | United Kingdom | 204/290 F |

*Primary Examiner*—Ronald H. Smith
*Assistant Examiner*—Richard Bueker
*Attorney, Agent, or Firm*—Oblon, Fisher, Spivak, McClelland & Maier

[57] ABSTRACT

An insoluble electrode for electrolysis is prepared by coating a solution or slurry comprising palladium oxide and a platinum compound which can be thermally decomposed to form platinum metal, and optionally another salt or oxide, on a conductive substrate and drying it and baking it at elevated temperature.

9 Claims, No Drawings

PROCESS FOR PREPARING INSOLUBLE ELECTRODE

This is a continuation of application Ser. No. 896,385, filed Apr. 14, 1979, now abandoned.

BACKGROUND OF THE INVENTION

1. Field of the Invention

The present invention relates to an improved process for preparing an electrode for electrolysis.

2. Description of the Prior Art

Heretofore, the alkali metal electrolysis such as sodium chloride electrolysis has been mainly carried out by the mercury process. Recently, the pollution of drainage containing mercury component caused by the mercury process has been discussed. The change of the process from the mercury process to diaphragm processes has been required.

The diaphragm processes have been usually worked at higher pH in the electrolysis in comparison with the mercury process. The known electrodes have low oxygen overvoltage. Accordingly, when the known electrodes are used for the diaphragm process or the ion-exchange membrane process about 1 to 3% of oxygen is included in the resulting chlorine, whereby the anolytic gas can not be directly fed into petrochemical plants etc. It is necessary to use the anolytic gas after removing oxygen. Accordingly, special equipments and complicated operations are required which increase the cost.

In order to overcome the disadvantages, an electrode which causes a smaller generation of oxygen should be used. The electrode potential of oxygen at equilibrium ($EO_2$) is lower than that of chlorine ($E_{Cl2}$). When an electrode which does not have any selectivity in the electrode reaction of oxygen and chlorine is used, a large amount of oxygen is generated at the potential for generating chlorine.

Thus, in order to reduce the generation of oxygen, it is necessary to use an electrode having a coating which has the characteristic inhibiting oxygen electrode reaction in the theory of reaction rates.

The selectivity of the electrode for the electrode reaction is called an electrocatalytic activity which has been estimated by an exchange current density of the coating of the electrode.

It has been known that platinum group metals such as Ru, Pd, Rh, Pt and Ir have such electro-catalysis. The exchange current densities of these platinum group metals on the oxygen electrode reaction are as follows.

$$Ru > Ir > Rh > Pd > Pt.$$

The exchange current densities on the chlorine electrode reaction are as follows.

$$Pd > Ru > Ir > Rh > Pt.$$

From the viewpoints of smaller generation of oxygen and superior electrocatalytic activity on the chlorine electrode reaction, palladium is optimum.

However, in the practical use, when palladium is coated in the form of palladium metal, the palladium metal coating is dissolved in the electrolysis and it can not be practically used because of inferior anticorrosive property.

In order to overcome these disadvantages, it has been proposed to use anticorrosive electrodes made of a Pt-Pd alloy or prepared by coating the Pt-Pd alloy on a substrate or by oxidizing the surface of the Pt-Pd alloy. (B.P. 1,147,442, B.P. 1,195,871).

However, the electrocatalytic activity of palladium itself could not be imparted because the alloy of palladium is used and the anticorrosive property for a long time of the electrode is not satisfactory.

It has been proposed to use an electrode made of Pt-Pd alloy oxide. (B.P. 1,147,442, B.P. 984,973). In order to form the alloy oxide on a titanium substrate, it is necessary to treat it at high temperature in an atmosphere of oxygen under high pressure. In the treatment, the titanium substrate is severely oxidized and it is difficult to use it as the electrode. Accordingly, in the proposed method, the Pt-Pd alloy is coated on the titanium substrate and the alloy oxide is formed by anodic oxidation. The characteristics of the electrode are substantially the same with those of the electrode prepared by oxidizing the surface of the Pt-Pd alloy.

On the other hand, the inventors have studied to coat palladium oxide on a substrate made of titanium etc. However, the adhesiveness of the titanium substrate and the palladium oxide is not enough, and this approach has not been successful.

The inventors have further studied and have succeeded to obtain an electrode which can be practically used, by adding a small amount of another metal oxide to a large amount of palladium oxide to improve the mechanical strength. However, it has not been successful to decrease the consumption of the electrode to substantially zero.

The inventors have further studied the reason why the perfect anticorrosive property can not be attained by coating palladium oxide on the titanium substrate and have found that the corrosion is caused by a small amount of metallic palladium. That is, when titanium is directly contacted with palladium oxide or the unreacted palladium compound in the preparation of the palladium oxide coating on the titanium substrate in the thermal decomposing process, the palladium compound is reduced with titanium whereby metallic palladium is formed to contaminate the palladium oxide.

Accordingly, it is considered that the anticorrosive property is deteriorated by using the electrode having the improved mechanical strength for a long time because the metallic palladium formed by the reduction is dissolved in the electrolysis and the coated layer becomes porous and the coating falls down with the generation of the gas from the surface of the electrode.

The inventors have found from these facts that the consumption of the electrode can be completely prevented by removing the small amount of metallic palladium as the by-product by forming an alloy with platinum in the thermal decomposing process for forming the palladium oxide coating. The present invention has been attained by these findings.

The inventors have succeeded to improve the anticorrosive property in relatively high degree by forming an alloy by reacting platinum with the unreacted palladium. However, the shunt current is passed through the palladium platinum alloy in high current density whereby the dissolution of the alloy can not be prevented and the anticorrosive property for a long operation has not been satisfactory. The present invention is the improvement of our previous invention disclosed in the copending applications U.S. Patent Ser. No.

863,425, British Patent Application No. 54341/77 and West German Patent Application No. P2800193.6.

SUMMARY OF THE INVENTION

It is an object of the present invention to provide a process for preparing an electrode for electrolysis which has high anticorrosive property.

It is another object of the present invention to provide a process for preparing an electrode which has a coating comprising palladium oxide and platinum metal without free palladium component on a conductive substrate such as titanium, tantalum or zirconium.

The foregoing and other objects of the present invention have been attained by preparing an insoluble electrode for electrolysis by coating a solution or slurry comprising palladium oxide and a platinum compound which can be thermally decomposed to form platinum metal, optionally another salt or oxide, on a conductive substrate and drying it and baking it at elevated temperature.

DETAILED DESCRIPTION OF THE PREFERRED EMBODIMENTS

The process for preparing the electrode of the present invention is different from the process coating a palladium compound which can be thermally decomposed, directly on a conductive substrate and thermally decomposed it on the conductive substrate.

The characteristic feature of the process of the present invention is to prepare palladium oxide before coating it by thermally decomposing palladium chloride in oxygen or oxidizing palladium black in air.

The resulting palladium oxide is dispersed in a solution of a platinum compound which can be thermally decomposed such as a butanol solution of chloroplatinic acid to prepare a coating slurry.

The coating slurry is coated on a conductive substrate whose surface was treated by a mechanical and chemical etching and it is then baked.

In accordance with the process of the present invention, the formation of palladium metal is not found and a coated layer having several times the thickness obtained by the conventional thermal decomposition process can be obtained in each coating. Moreover, the particles of the coated palladium oxide are larger than those of the conventional thermal decomposition process whereby the anticorrosive property of the electrode prepared by the process of the present invention is superior to that of the conventional one.

The platinum component mixed with the palladium oxide in the coated layer should be platinum metal. This is important for highly bonding the coated palladium oxide on the conductive substrate and improving the electric contact between the palladium oxide particles whereby the electric resistance of palladium oxide for imparting electrochemical catalytic activity is reduced.

The main feature of the present invention is to prepare an electrode coating comprising palladium oxide and platinum. In order to improve the mechanical strength of the coated layer of the electrode, palladium oxide and a platinum compound which can be thermally decomposed such as chloroplatinic acid, and a compound of cerium, zirconium, titanium, tantalum or tungsten which can be thermally decomposed to form the corresponding oxide such as a chloride or organic salt thereof e.g. chloride or alkyl compound, are added.

The conditions of thermal decomposition are chosen so as to preferably control the oxygen partial pressure to 0.002 to 0.5 atm. and the bake at 400° to 800° C. for 5 to 10 minutes in each coating and to repeat the operation for several times and then to bake for 10 to 60 minutes at the final step.

The solvent used in the process of the present invention is preferably water, ethanol or butanol.

It is possible to add a dispersing agent such as a cationic surfactant, an anionic surfactant or a nonionic surfactant as desired.

The concentration of these compounds in the solvent is usually in a range of 0.01 to 10 g/cc especially 0.2 to 2 g/cc as total metal contents and is chosen depending upon the viscosity, the easiness of coating and the thickness of the coated layer.

As described, in accordance with the process of the present invention, a palladium component is included in a form of palladium oxide in the coating slurry together with the platinum compound and the coating slurry is coated on the conductive substrate and baked to prevent the formation of palladium metal.

In our previous process, palladium platinum alloy is formed by reacting the unreacted palladium metal with platinum metal and the anticorrosive property of the alloy is low and the electrode is deteriorated.

In accordance with the process of the present invention, there is not such disadvantages of the low anticorrosive property and the deterioration of the electrode whereby an insoluble electrode having excellent anticorrosive property and excellent catalytic activity can be attained.

Incidentally, it is preferable to prepare the coating slurry so as to give a composition of the coated layer comprising 99 to 5 mole % of PdO and 1 to 95 mole % of Pt from the viewpoint of the anticorrosive property.

The accelerated test for the anticorrosive property of the electrode of the present invention was carried out by the Vaaler's method (J. Electro Chem. Soc., 117,219 (1970)) with the chlorine saturated aqueous solution of sodium chloride (2.5 mole/liter) at 65° C. at pH of 3 in a current density of 100 A/dm$^2$ in the electrolysis.

The present invention will be further illustrated by certain references and examples.

EXAMPLE 1

A titanium disc substrate having a diameter of 13 mm and a thickness of 1 mm, was washed for dewaxing with trichloroethylene and the surface of the substrate was dissolved by treating it with a 10% aqueous solution of oxalic acid at 80° C. for 30 to 300 minutes.

A 0.8 g of chloroplatinic acid was dissolved in 8 ml of ethyl alcohol and 0.2 g of palladium oxide powder was added to the solution. The mixture was ground by a ball-mill for 300 minutes to form a coating slurry. Then, the coating slurry was coated with a brush on the titanium substrate and dried at 100° to 200° C. and baked at 550° C. in air for 10 minutes. The operation was repeated for 4 times. At the 5th operation, it was baked at 550° C. in air for 30 minutes to prepare an electrode.

The electrode was analyzed by the X-ray diffraction to find no free palladium metal and to confirm the layer consisting of 30 mole % of PdO and 70 mole % of Pt. The electrode was analyzed by the X-ray diffraction to find that the product of the layer consists of palladium oxide and palladium metal formed by the reduction with titanium.

An electrolysis of a chlorine saturated aqueous solution of NaCl (2.5 mole) was carried out at 65° C. at pH of 3 in the current density of 100 A/dm$^2$ for 2000 hours by using the resulting electrode (Vaaler's accelerated test). After the electrolysis, the consumption of the electrode was analyzed by the fluorescent X-ray analysis. The result is shown in Table 1.

As the references, in accordance with the same process, each electrode was prepared by using a solution of palladium chloride and chloroplatinic acid in ethyl alcohol to form an electrode A having a coated layer of PdO-(Pd-Pt) alloy or an electrode B having a coated layer of Pd-Pt alloy and by oxidizing the surface of the electrode B at elevated temperature in air for 3 hours to form an electrode C.

The results of the anticorrosive tests under the same condition are also shown in Table 1.

TABLE 1

| Type of electrode | Chlorine overvoltage $\eta Cl_2$ (V) initiation | Chlorine overvoltage after electrolysis | Loss of Pd component (%) |
|---|---|---|---|
| Electrode of invention | 0.02 | 0.02 (after 2000 hr.) | 0.5 (after 2000 hr.) |
| Electrode A | 0.02 | 0.02 (after 2000 hr.) | 1.0 (after 2000 hr.) |
| Electrode B | 0.10 | 0.3–0.4 (after 5 hr.) | 10 (after 5 hr.) |
| Electrode C | 0.02 | 0.2–0.25 (after 2000 hr.) | 30 (after 2000 hr.) |

It is clear from Table 1 that the electrode prepared by the process of the present invention had remarkably superior anticorrosive property to those of our previous invention though the chlorine-overcoltage had no difference. Moreover, the electrode prepared by the process of the present invention had remarkably superior anticorrosive property and chlorine-overvoltage to those of the conventional electrode having the Pd-Pt alloy coating or the electrode having the oxidized Pd-Pt alloy coating.

EXAMPLE 2

In accordance with the process of Example 1 except varying the concentration of palladium oxide and platinum component, the electrodes were prepared and the characteristics were measured.

The results are shown in Table 2.

TABLE 2

| Sample No. | Components of coating (mole %) PdO | Components of coating (mole %) Pt | Condition for preparation baking temp. | Condition for preparation baking time | Characteristics initial overvoltage (V) | Characteristics loss of Pd component (%) |
|---|---|---|---|---|---|---|
| 1 | 100 | 0 | 550° C. | 5 min. 4 times 10 min. 1 time | 0.02 | 30 |
| 2 | 90 | 10 | " | 5 min. 4 times 10 min. 1 time | " | 10 |
| 3 | 80 | 20 | " | 5 min. 4 times 10 min. 1 time | " | 5 |
| 4 | 70 | 30 | " | 5 min. 4 times 10 min. 1 time | " | 2 |
| 5 | 60 | 40 | " | 5 min. 4 times 10 min. 1 time | " | 1 |
| 6 | 50 | 50 | " | 5 min. 4 times 10 min. 1 time | " | 0.5 |
| 7 | 40 | 60 | " | 5 min. 4 times 10 min. 1 time | " | " |
| 8 | 30 | 70 | " | 5 min. 4 times 10 min. 1 time | 0.03 | " |
| 9 | 20 | 80 | " | 5 min. 4 times 10 min. 1 time | 0.05 | " |
| 10 | 10 | 90 | " | 5 min. 4 times 10 min. 1 time | 0.07 | " |
| 11 | 0 | 100 | " | 5 min. 4 times 10 min. 1 time | 0.1 | " |

EXAMPLE 3

A titanium disc substrate having a diameter of 13 mm and a thickness of 1 mm, was washed for dewaxing with a trichloroethylene and the surface of the substrate was dissolved by treating it with 10% aqueous solution of oxalic acid in boiling condition for 30 to 300 minutes.

A mixture of 0.8 g of chloroplatinic acid and 0.1 g of cerium chloride and 0.1 g of zirconium oxychloride was dissolved in a mixture of 1 to 2 ml of hydrochloric acid and 9 ml of ethyl alcohol and 0.2 g palladium oxide powder was added to the solution. The mixture was ground by a ball-mill for 300 minutes to form a coating slurry. Then, the coating slurry was coated with a brush on the titanium substrate and dried at 100° to 200° C. and baked at 550° C. in air for 30 minutes. The operation was repeated for 5 times to prepare an electrode.

The electrode was analyzed by the X-ray diffraction to find no free palladium metal and to confirm only the diffraction lines of PdO and Pt and $Ce_2O_3$ and $ZrO_2$.

The anticorrosive test of the electrode was carried out by the Vaaler's accelerated test. As the result, the loss of Pd component was 0.5%.

In order to compare the bonding strength of the coated layer and the substrate, the ultrasonic vibration peeling-off test was carried out. The peeling-off of palladium oxide was about 10% which was higher than those of the electrodes prepared by the processes of Examples 1 and 2.

In accordance with the process for preparing the electrodes of the present invention, excellent characteristics of palladium oxide is attained to provide an anode especially suitable for an electrolysis of an aqueous solution of an alkali metal chloride.

What is claimed is:

1. A process for preparing an insoluble electrode for electrolysis which comprises:

coating a conductive substrate with a solution or slurry comprising preformed palladium oxide and a platinum compound which can be thermally decomposed to form platinum metal;

drying said coated substrate and baking said substrate at an elevated temperature sufficient to decompose said platinum compound to platinum metal, thereby forming on said substrate a coat which comprises a mixture of platinum metal and palladium oxide.

2. A process according to claim 1 wherein the conductive substrate is made of titanium, tantalum or zirconium.

3. A process according to claim 1 wherein the coated layer is formed by baking said conductive substrate coated with a solution of palladium oxide and said platinum compound in the presence of oxygen.

4. A process according to claim 3 wherein the coated layer is formed by repeatedly baking said substrate coated with a solution of palladium oxide and said platinum compound in the presence of oxygen.

5. A process according to claim 1 wherein the solvent is water or an alcohol.

6. A process according to claim 1 wherein the platinum compound is a halide, a carboxylic acid salt or a haloplatinic acid.

7. A process according to claim 1 wherein the solution or slurry is prepared so as to give a coated layer comprising 99 to 5 mole % of palladium oxide and 1 to 95 mole % of platinum metal.

8. A process according to claim 1 wherein a compound of cerium, zirconium, titanium, tantalum or tungsten which can be thermally decomposed to form the oxide thereof is added to said slurry.

9. The process of claim 1 wherein said baking temperature is 400°–800° C.

* * * * *

UNITED STATES PATENT AND TRADEMARK OFFICE

CERTIFICATE OF CORRECTION

PATENT NO. : 4,248,906

DATED : February 3, 1981

INVENTOR(S) : SHINJIRO SAITO ET AL

It is certified that error appears in the above—identified patent and that said Letters Patent is hereby corrected as shown below:

Please correct the Related U.S. Application Data to read as follows:

[63]--Related U.S. Application Data

Continuation of Ser. No. 896,385, Apr. 14, 1978, abandoned. --rather than--

[63]--Related U.S. Application Data

Continuation of Ser. No. 896,385, Apr. 14, 1979, abandoned as it now appears.

Signed and Sealed this

*Twelfth* Day of *May 1981*

[SEAL]

*Attest:*

RENE D. TEGTMEYER

*Attesting Officer* *Acting Commissioner of Patents and Trademarks*